US005358744A

United States Patent [19]

Buscarlet et al.

[11] Patent Number: 5,358,744

[45] Date of Patent: Oct. 25, 1994

[54] PROCESS FOR COATING A FERRITIC STAINLESS STEEL STRIP WITH ALUMINUM BY HOT QUENCHING

[75] Inventors: Eric Buscarlet, Mareil-Marly; Charles G. Brun, Chantilly; Danielle Quantin, Montataire; Jean-Paul Hennechart, Mouzon; Marc Mantel, Albertville; Patrice de Veyrac, Versailles; Bernard Baroux, Saint Jorioz, all of France

[73] Assignees: Sollac; Ugine, Aciers de Chatillon & Gueugnon, both of Puteaux, France

[21] Appl. No.: 43,608

[22] Filed: Apr. 5, 1993

Related U.S. Application Data

[63] Continuation of Ser. No. 727,846, Jul. 11, 1991, abandoned.

[30] Foreign Application Priority Data

Jul. 16, 1990 [FR] France ..... 90 09048

[51] Int. Cl.[5] ..... B05D 3/02

[52] U.S. Cl. ..... 427/320; 427/432

[58] Field of Search ..... 427/320, 321, 432, 433, 427/434.3; 148/531; 428/653, 685

[56] References Cited

U.S. PATENT DOCUMENTS

| | | | |
|---|---|---|---|
| Re. 29,726 | 8/1978 | Byrd et al. | 427/433 |
| 2,926,103 | 2/1990 | Brick | 427/320 |
| 3,320,085 | 5/1967 | Turner, Jr. | 427/321 |
| 3,925,579 | 12/1975 | Flinchum et al. | 427/320 |
| 4,053,663 | 10/1977 | Caldwell et al. | 427/320 |
| 4,140,552 | 2/1979 | Arnold et al. | 427/320 |
| 4,144,379 | 3/1979 | Patil et al. | 427/320 |
| 4,584,211 | 4/1986 | Higuchi et al. | 427/320 |
| 4,591,395 | 5/1986 | Steele, Jr. et al. | 428/653 |
| 4,675,214 | 6/1987 | Kilbane et al. | 427/320 |
| 4,913,785 | 4/1990 | Uchida et al. | 205/193 |
| 5,023,113 | 6/1991 | Boston et al. | 427/320 |

FOREIGN PATENT DOCUMENTS

| | | | |
|---|---|---|---|
| 0134143 | 3/1985 | European Pat. Off. . | |
| 0356783 | 3/1990 | European Pat. Off. . | |
| 57-169089 | 10/1982 | Japan | 428/653 |
| 2-163357 | 6/1990 | Japan | 427/320 |

*Primary Examiner*—Terry J. Owens

*Attorney, Agent, or Firm*—Cushman, Darby & Cushman

[57] ABSTRACT

A process for coating a steel strip, particularly ferritic stainless steel, with aluminum by hot quenching, in which the strip is preheated to a temperature less than 500° C. in a first non-oxidizing atmosphere containing a quantity of oxygen less than 3%, the strip is then heated to a temperature less than 950° C. in a second non-oxidizing atmosphere, the strip is then conveyed to an atmosphere (3, 4) which is non-reactive at the coating temperature, and, finally, the strip is quenched in a coating bath.

12 Claims, 2 Drawing Sheets

PROCESS FOR COATING A FERRITIC STAINLESS STEEL STRIP WITH ALUMINUM BY HOT QUENCHING

This is a continuation of application Ser. No. 07/727,846, filed on Jul. 11, 1991, now abandoned.

The present invention relates to a process for coating a steel strip, particularly ferritic stainless steel, with aluminium by hot quenching.

The present invention also relates to a steel strip produced by such a process.

BACKGROUND OF THE INVENTION

EP-A-0,246,418 discloses a process for aluminising a ferritic stainless steel strip by hot quenching in which the strip is preheated to approximately 677° C. in order to clean its surface and this strip is heated above 843° C. in a reducing atmosphere.

The strip is then cooled in an atmosphere containing at least 95% hydrogen and then, avoiding any contact with the ambient air, the said strip is quenched in a bath of molten aluminium and is dried.

This known process presents several drawbacks.

Firstly, the preheating oxidises the surface of the strip considerably, which means that the strip has to be passed through a hydrogen atmosphere in order to reduce the oxides formed on its surface.

This process applies more particularly to coating with pure aluminum.

SUMMARY OF THE INVENTION

In point of fact, on contact with steel, aluminium, when pure, combines with the iron in order to form a brittle iron/aluminium alloy which limits the deformation usability of the coating layer and the use properties of the steel strips coated in this manner.

The aim of the present invention is to remedy these drawbacks, firstly by avoiding the use of a gas containing at least 95% hydrogen and, secondly, by making it possible to produce coatings with an aluminium/silicon alloy.

In fact, the presence of silicon in the coating bath makes it possible to control the formation of the brittle iron/aluminium alloy.

The present invention thus relates to a process for coating a steel strip, particularly ferritic stainless steel, with aluminium by hot quenching, characterised in that:

- the strip is preheated to a temperature less than 500° C. in a first non-oxidising atmosphere,
- the said strip is heated to a temperature less than 950° C. in a second non-oxidising atmosphere,
- the said strip is then conveyed to an atmosphere which is non-reactive at the coating temperature,
- and, finally, the said strip is quenched in a coating bath.

According to other characteristics:

- the said first non-oxidising atmosphere contains less than 3% oxygen,
- the said second non-oxidising atmosphere has a dew point less than −40° C. and preferably less than −50° C.,
- the said non-reactive atmosphere is nitrogen,
- the said non-reactive atmosphere is a nitrogen/hydrogen mixture,
- the nitrogen contains less than 20 ppm of oxygen and has a dew point less than −60° C.,

- the hydrogen contains less than 10 ppm of oxygen and has a dew point less than −60° C.,
- the residence time of any portion of the strip in the said first non-oxidising atmosphere is less than 60 seconds and preferably less than 45 seconds,
- the said second non-oxidising atmosphere is contained in a first zone formed by a hearth furnace and in a second zone formed by a holding furnace,
- the residence time of any portion of the strip in the hearth furnace is less than 120 seconds and preferably less than 90 seconds,
- the residence time of any portion of the strip (8) in the holding furnace is less than 220 seconds and preferably less than 190 seconds,
- the said coating bath is aluminium,
- the said coating bath is a mixture of aluminium and of silicon containing a maximum of 11% by weight of silicon.

The invention also relates to a steel strip produced by the abovementioned process.

The steel strip is preferably a ferritic stainless steel strip containing a minimum of 4% by weight and a maximum of 25% by weight of chromium.

BRIEF DESCRIPTION OF THE DRAWINGS

The invention will now be described in greater detail with reference to the appended figures, in which.

DETAILED DESCRIPTION OF THE INVENTION

Figure 1:
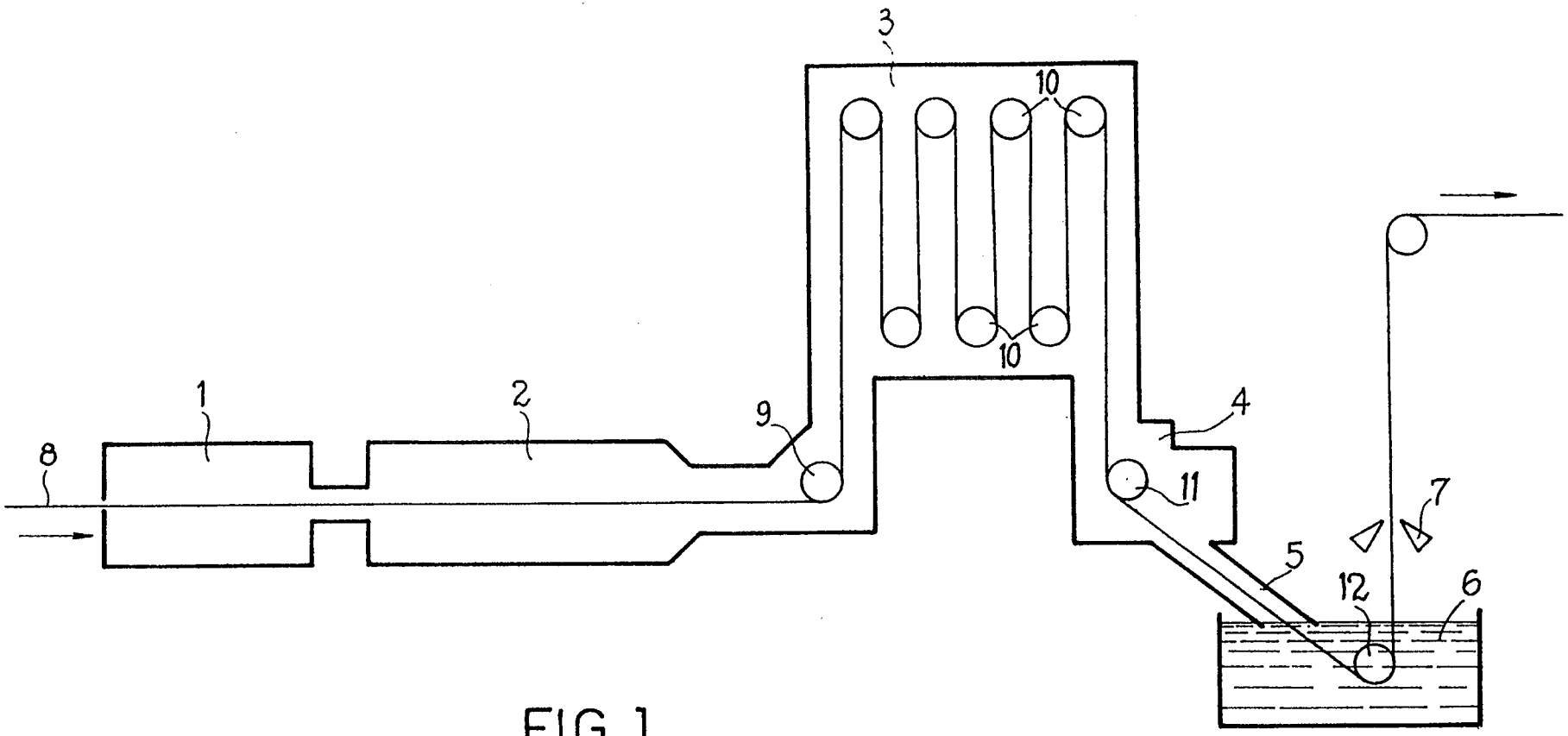
FIG. 1 is a diagrammatic view of a continuous coating plant for implementing the process according to the invention.

As shown in FIG. 1, the continuous coating plant comprises:

- a preheating furnace 1,
- a hearth furnace 2,
- a holding furnace 3,
- a cooling zone 4,
- a chute 5,
- a molten metal coating bath 6,
- and drying nozzles 7.

The steel strip 8, particularly ferritic stainless steel, enters the plant via the preheating furnace 1 where the atmosphere is a first non-oxidising atmosphere containing less than 3% oxygen.

At the exit of this preheating furnace, the temperature of the strip 8 is less than 500° C. and preferably equal to 460° C., the residence time of any portion of the said strip in this preheating furnace being less than 60 seconds and preferably less than 45 seconds.

The strip 8 then passes through the hearth furnace 2, and is then deflected by a roller 9 in order to enter the holding furnace 3 where it zigzags around rollers 10.

The atmosphere prevailing in the hearth furnace 2 and in the holding furnace 3 consists of a second non-oxidising atmosphere and this atmosphere is regulated in order to have, throughout, a dew point less than −40° C. and preferably less than −50° C.

At the exit from the hearth furnace 2, the temperature of the strip 8 is less than 950° C. and preferably equal to 900° C., the residence time of any portion of the said strip in this furnace being less than 120 seconds and preferably less than 90 seconds.

In the holding furnace 3, the temperature of the strip 8 is held at a temperature less than 950° C. and preferably equal to 900° C., the residence time of any portion of the said strip in this holding furnace being less than 220 seconds and preferably less than 190 seconds.

At the exit from the holding furnace 3, the strip 8 enters the cooling zone 4 and is then deflected by a roller 11 in order to pass through the chute 5 and in order to plunge into the coating metal bath 6.

Then, after being deflected by a roller 12, the strip 8 is dried by gas blown through the nozzles 7 and is discharged.

In the cooling zone 4, the non-reactive atmosphere is composed of a mixture of nitrogen and hydrogen and the temperature of the strip is brought to a value in the region of the temperature of the coating metal bath 6, preferably between 660° C. and 730° C.

In the chute 5, the temperature of the strip 8 virtually does not vary and the atmosphere of the said chute is either a mixture of nitrogen and hydrogen or is pure nitrogen.

The nitrogen used to produce the mixture of nitrogen and hydrogen or to form the atmosphere of the chute 5 contains less than 20 ppm of oxygen and has a dew point less than −60° C.

The hydrogen used to produce the mixture of nitrogen and hydrogen has an oxygen content less than 10 ppm and a dew point less than −60° C.

Given the atmosphere adjustments indicated above, the surface of the strip is not oxidised at the entry of the cooling zone.

Figure 2:
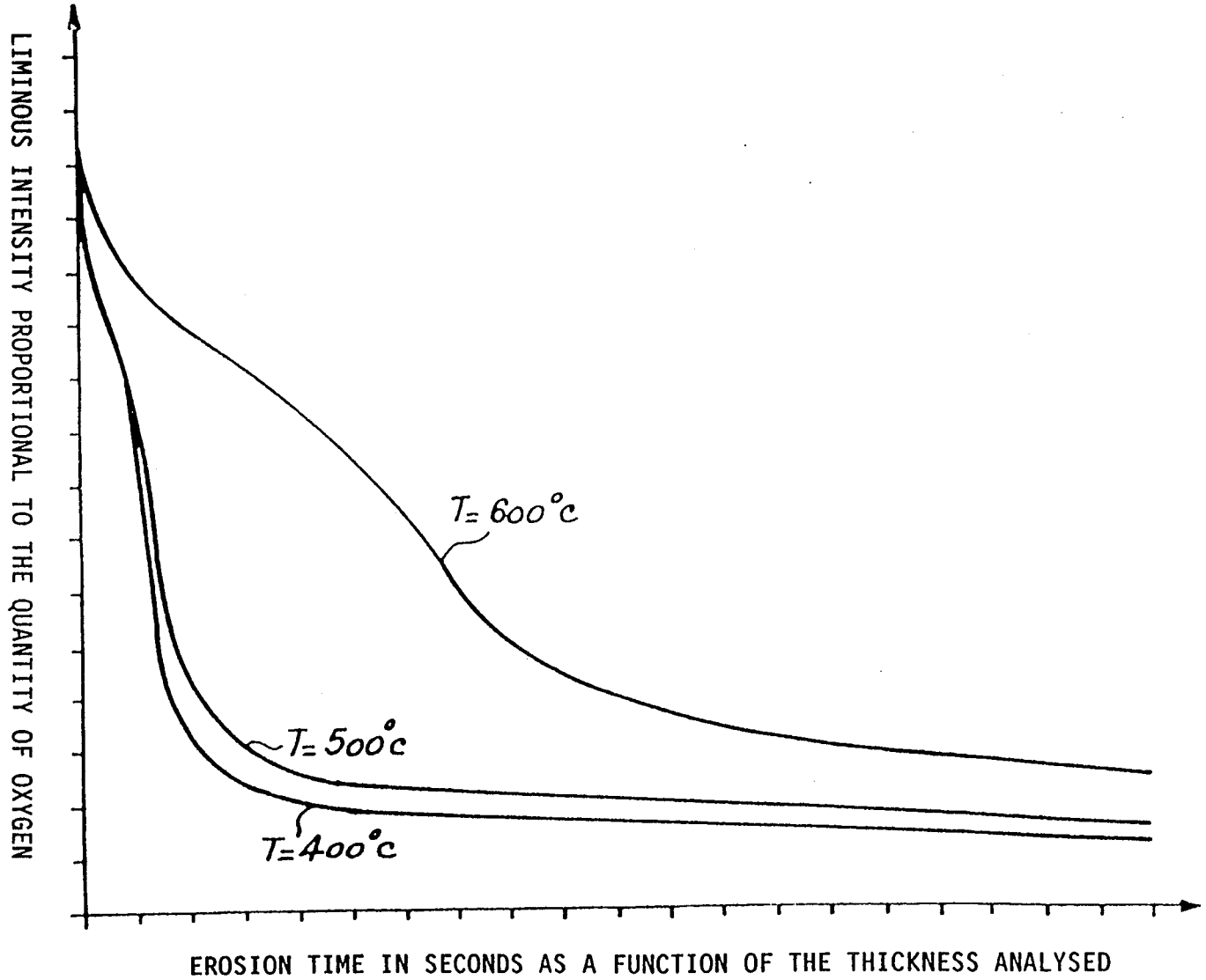
FIG. 2 shows curves characteristic of a measurement using discharge luminescence spectrometry (DLS), giving the relative quantities of the element oxygen detected on the surface at different temperatures T under a first non-oxidising atmosphere.

Remarkably, as is shown in FIG. 2, the quantity of elemental oxygen detected on the surface on different steel strips which have been preheated to different temperatures T in the preheating furnace 1 increases considerably when the temperature of the said tested strips exceeds 500° C.

In DLS characteristics, the luminous intensity is proportional to the quantity of oxygen contained on the surface in the steel strip, the erosion time being linked to the thickness of the layer analysed.

It will be observed that the quantity of oxygen on the surface for two temperatures T=400° C. and T=500° C. is of the same order of magnitude, whereas the quantity of oxygen is relatively high for the temperature T=600° C.

When the temperature of the strip in the preheating furnace 1 is held at approximately 500° C., it is unnecessary to maintain a hydrogen atmosphere in the cooling zone and in the chute.

The cooling metal bath 6 is a mixture of aluminium and of silicon containing up to approximately 11% of silicon by weight.

By way of example, a first ferritic stainless steel strip was coated by quenching in a bath of virtually pure aluminium under the following conditions:

| | |
|---|---|
| preheating furnace 1: | |
| ambient temperature | 814° C. |
| temperature of the strip exiting the furnace | 437° C. |
| oxygen content of the atmosphere | <2% |
| hearth furnace 2 and holding furnace 3: | |
| temperature of exiting strip | 857° C. |
| atmosphere: | |
| nitrogen | 40% |
| hydrogen | 60% |
| dew point | −50° C. |
| cooling zone 4 and chute 5: | |
| temperature of exiting strip | 710° C. |
| atmosphere: | |
| nitrogen | 100% |
| coating bath 6: | |
| contents of aluminium | 96.92% |
| silicon | 0.18% |
| iron | 2.9% |

-continued

The coating layer obtained has a weight per square meter of 89 g/m² and the following composition:

| | |
|---|---|
| silicon | 1% |
| iron | 19% |
| aluminium | 80% |

The ferritic stainless steel forming the strip is of the Al Si 409 type and contains by weight:

| | |
|---|---|
| C: 0.01% | Cr: 11.5% |
| Si: 0.5% | Ti: 0.2% |

An adhesive test on m alternate folds performed on this strip gave a result of 60. This figure characterises the adherence of the coating to the strip, adherence being poor when it is equal to 0 and good when it is equal to 100.

A second ferritic stainless steel strip of the same composition as the preceding one was coated by quenching in a bath containing a mixture of aluminium and of silicon and under the following conditions:

| | |
|---|---|
| preheating furnace 1: | |
| ambient temperature | 914° C. |
| temperature of strip exiting furnace | 462° C. |
| oxygen content of the atmosphere | <2% |
| hearth furnace 2 and holding furnace 3: | |
| temperature of exiting strip | 845° C. |
| atmosphere: | |
| nitrogen | 40% |
| hydrogen | 60% |
| dew point | −50° C. |
| cooling zone 4 and chute 5: | |
| temperature of exiting strip | 711° C. |
| atmosphere: | |
| nitrogen | 100% |
| coating bath 6: | |
| contents of aluminium | 87.6% |
| silicon | 9.1% |
| iron | 3.3% |

The coating layer thus obtained has a weight per square meter of 118 g/m² and the following composition:

| | |
|---|---|
| aluminium | 86.8% |
| silicon | 6% |
| iron | 7.2% |

The adhesive test on m alternate folds gave a result of 80.

Thus, the process according to the invention makes it possible to avoid using pure hydrogen and also makes it possible to obtain coating layers with a high silicon content which have better behaviour during the adhesive test than that obtained with coatings having a very low silicon content.

We claim:

1. A process for aluminizing a ferritic stainless steel strip, by hot quenching, in a continuous coating plant consisting of:

i) preheating a ferritic stainless steel strip to a temperature less than 500° C. in a first non-oxidizing atmosphere wherein said first non-oxidizing atmosphere contains less than 3% by volume oxygen, ii) heating the product of step (i) to a temperature less than 950° C. in a second non-oxidizing atmosphere of nitrogen and hydrogen, wherein said second non-oxidizing atmosphere has a dew point less than −40° C., iii) conveying the product of step (ii) to an atmosphere consisting of nitrogen above a coating bath, and iv) quenching the product of step (iii) in said coating bath.

2. The process according to claim 1, wherein the second non-oxidizing atmosphere has a dew point of less than −50° C.

3. The process according to claim 1, wherein the second non-oxidizing atmosphere consists essentially of hydrogen and nitrogen.

4. The process according to claim 1, wherein the nitrogen of the second non-oxidizing atmosphere contains less than 20 ppm of oxygen and has a dew point less than −60° C.

5. The process according to claim 4, wherein the hydrogen of the second non-oxidizing atmosphere contains less than 10 ppm of oxygen and has a dew point less than −60° C.

6. The process according to claim 1, wherein the residence time of preheating of any portion of the ferritic stainless steel strip in the first non-oxidizing atmosphere of step (i) is greater than zero and less than 60 seconds.

7. The process according to claim 1, wherein said second non-oxidizing atmosphere is contained in a first zone formed by a hearth furnace and in a second zone formed by a holding furnace.

8. The process according to claim 7, wherein the residence time of any portion of the products of step (i) in said hearth furnace is greater than zero seconds and less than 120 seconds.

9. The process according to claim 2, wherein the residence time of any portion of the product of step (i) in said holding furnace is greater than zero seconds and less than 220 seconds.

10. The process according to claim 1, wherein the residence time of heating of any portion of the product of step (i) in the second non-oxidizing atmosphere of step (ii) is greater than 0 and less than 340 seconds.

11. The process according to claim 1 wherein said heating further comprises a first heating followed by a second heating wherein the residence time of said first heating any portion of the product of step (i) is greater than zero seconds and less than 120 seconds.

12. The process according to claim 1, wherein said heating further comprises a first heating followed by a second heating wherein the residence time of said second heating of any portion of the product of said first heating is greater than zero seconds and less than 220 seconds.

* * * * *